US007308898B2

(12) United States Patent
Monsalud, Jr. et al.

(10) Patent No.: US 7,308,898 B2
(45) Date of Patent: Dec. 18, 2007

(54) PROCESS FOR MAKING A BANDCAST TOBACCO SHEET AND SMOKING ARTICLE THEREFROM

(75) Inventors: Luis Monsalud, Jr., Macon, GA (US); Joseph T. Wanna, Macon, GA (US); Douglas R. Hicks, McDonough, GA (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 651 days.

(21) Appl. No.: 10/811,270

(22) Filed: Mar. 26, 2004

(65) Prior Publication Data

US 2004/0177856 A1 Sep. 16, 2004

Related U.S. Application Data

(63) Continuation-in-part of application No. 10/299,231, filed on Nov. 19, 2002, now Pat. No. 6,827,087.

(51) Int. Cl.
*A24B 3/14* (2006.01)
*A24B 15/12* (2006.01)
*A24B 1/00* (2006.01)

(52) U.S. Cl. ..... 131/358; 131/357; 131/355; 131/353; 131/360; 131/370; 131/372

(58) Field of Classification Search ..... 131/353, 131/355, 357, 358
See application file for complete search history.

(56) References Cited

U.S. PATENT DOCUMENTS 2,769,734 A * 11/1956 Bandel ..... 131/355
3,165,105 A 1/1965 Campbell
3,419,543 A 12/1968 Mold et al.
3,526,231 A 9/1970 Verbakel
3,540,456 A 11/1970 McGlumphy et al.
4,002,179 A 1/1977 Rundberg, Jr. et al.
4,109,663 A 8/1978 Maeda et al.
4,119,106 A 10/1978 Grubbs et al.
4,336,812 A 6/1982 Seragnoli
4,666,550 A 5/1987 Spiers et al.
4,739,775 A 4/1988 Hampl, Jr.
4,936,920 A * 6/1990 Keritsis et al. ..... 131/77
5,092,353 A * 3/1992 Montoya et al. ..... 131/360
5,129,408 A * 7/1992 Jakob et al. ..... 131/352

(Continued)

OTHER PUBLICATIONS

Prowse, R.L., "Reconstituted ('Sheet') Tobaccos; A review of processes, product properties and future potential" British-American Tobacco Co. Ltd. (Feb. 26, 1993)—Accessed Jul. 30, 2007 on www.tobaccodocuments.org.*

*Primary Examiner*—Steven P. Griffin
*Assistant Examiner*—Jason Lazorcik
(74) *Attorney, Agent, or Firm*—Charles I. Sherman; Middleton Reutlinger

(57) ABSTRACT

A bandcast tobacco sheet for use in a cigarette includes from about 5 to 15% by weight of wood pulp, from about 15 to 40% by weight of binder and from about 15 to 40% by weight of tobacco. A humectant may be included up to 30% by weight and an additive, such as menthol, may be added to up about 30% by weight. A bandcast tobacco sheet is used in elongated strips along the outer surface of a tobacco rod between the tobacco rod and an inner surface of an outer wrap of cigarette paper.

20 Claims, 1 Drawing Sheet

U.S. PATENT DOCUMENTS 5,139,034 A 8/1992 Chan
5,144,966 A 9/1992 Washington
5,156,169 A 10/1992 Holmes et al.
5,169,481 A 12/1992 Braunshteyn et al.
5,200,020 A 4/1993 Collins et al.
5,398,702 A 3/1995 Belvederi
5,415,186 A * 5/1995 Casey et al. ..... 131/194
5,692,526 A 12/1997 Adams et al.
5,845,649 A 12/1998 Saito et al.
6,129,087 A 10/2000 Wallace et al.
6,142,154 A 11/2000 Dall'Osso et al.
6,325,859 B1 12/2001 De Roos et al.
6,606,999 B2 8/2003 Crooks et al.
6,705,325 B1 3/2004 Hicks et al.
6,860,274 B2 3/2005 Matsufuji et al.

* cited by examiner

PROCESS FOR MAKING A BANDCAST TOBACCO SHEET AND SMOKING ARTICLE THEREFROM

CROSS-REFERENCE TO RELATED APPLICATIONS

This application is a continuation in part of U.S. application Ser. No. 10/299,231 filed Nov. 19, 2002, now U.S. Pat. No. 6,827,087.

BACKGROUND OF THE INVENTION

The present invention relates to a process for making a bandcast reconstituted tobacco sheet and more particularly to a process for making a bandcast reconstituted tobacco sheet including a flavoring compound contained in a gel matrix within the reconstituted tobacco sheet.

In the manufacturing of smoking articles and particularly cigarettes, it is common to use in the tobacco blend a percentage of strips of reconstituted tobacco. The reconstituted tobacco is generally prepared from tobacco fines, veins, stems and other undesirable tobacco products which are further processed and formed into sheets, cut into strips and blended in with fresh cut tobacco. The amount of reconstituted tobacco used in a tobacco blend for a smoking article varies, but is generally less than 10%. Usually these reconstituted tobacco sheets are absent of additional flavoring compounds as it has been found that the flavoring compounds, such as menthol, evaporate or dissipate rapidly from the sheet prior to blending with other tobacco and therefore provide little to no additional flavoring benefit to the tobacco blend.

Additionally, there has been great concern for the reduction of the ignition propensity of smoking articles as there have been a substantial number of fires which have been attributed to burning cigarettes coming into contact with combustible or flammable materials. Therefore, there is a considerable effort being expended in the industry to provide smoking articles which provide a low ignition propensity smoking article. Many of these proposals include a modification of the wrapper for the smoking article. Particularly, coatings or additives have been made to wrappers for the smoking articles to reduce the porosity or to change the chemical properties of the wrapper.

SUMMARY OF THE INVENTION

It is an object of the present invention to provide a novel formulation for a bandcast reconstituted tobacco sheet and the process for making same.

It is also an object of the present invention to provide a smoking article, including a novel bandcast reconstituted tobacco sheet in one layer of a wrapper for the smoking article.

The present invention provides a bandcast tobacco sheet which includes from about 15 to 40% by weight of tobacco, from about 5 to 15% weight of wood pulp, from about 15 to 40% by weight of binder and up to 30% by weight of a flavoring compound, such as menthol.

The present invention also provides a process for making a bandcast tobacco sheet which includes as a first step of making a slurry including tobacco, wood pulp, binder and menthol. The prepared slurry is cast onto a movable band or screen and subsequently dried to form a sheet of reconstituted tobacco. The resulting tobacco sheet is cut into lengths of preselected widths for use in a smoking article. In one embodiment, the strips are positioned longitudinally of the tobacco rod between the tobacco rod and an outer cigarette or smoking article wrapper.

In preparing the bandcast material, the wood pulp and binder, particularly an alginate, such as sodium alginate, are added for sheet strength and binding of the ingredients into the tobacco sheet. A humectant, such as glycerine, may also be added for sheet pliability in addition to any desired flavorants; such as, menthol, as well as other filler, such as calcium carbonate. The proportion of the materials varies and is dependent upon end uses. However, in a preferred sheet, the amount of tobacco in the mixture is usually approximately the same as the binder, such as sodium alginate, but the tobacco may exceed the alginate by 10 to 20% by weight.

Additional objects and advantages of the present invention will become apparent to those skilled in the art upon consideration of the following detailed description including examples of the preparation of the bandcast reconstituted tobacco sheet of the present invention.

DETAILED DESCRIPTION OF THE PREFERRED EMBODIMENTS

Figure 1:
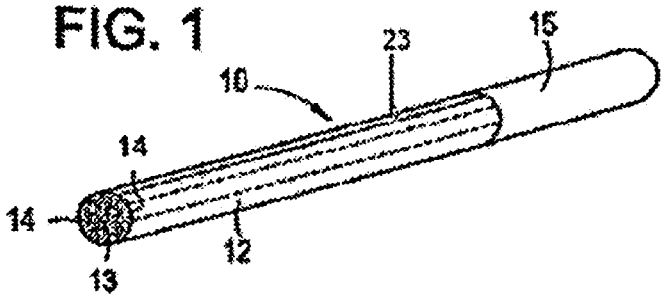
FIG. 1 is a perspective view of a partial cigarette of the present invention using the reconstituted tobacco bandcast sheet of the present invention.

A cigarette with burn rate modification is shown in FIG. 1 and may be described as a partial double wrap cigarette 10. As seen therein, the partial double wrap cigarette 10 of the present invention incorporates a standard column of tobacco 13 which extends from an exposed end to the filter 15. Circumscribing the tobacco column 13 is the outer wrap of the cigarette paper 12. Interior of the outer wrap cigarette paper 12 is a separate partial inner wrap layer or strip 14. The separate partial inner wrap layer 14 acts as a burn rate modifier for the tobacco column 13 by altering the burn characteristics of the cigarette 10. As can be seen from the embodiment shown in FIG. 1, the inner wrap layer strips may be co-axial to the tobacco column 13 and may extend substantially the length of the tobacco column from the exposed end to the filter 15. By insertion of the separate partial inner wrap layer 14 which in this embodiment extends co-axial to the tobacco column 13, modification may be made to the burn rate of the cigarette in such a manner that the burn rate may be adjusted depending upon the packing density of the tobacco, porosity of the outer wrap paper 12 and additives to the outer wrap, width of the separate partial inner wrap layer 14, porosity of the inner wrap layers 14, and additives to the inner wrap strips. Alternatively, the inner wrap layer may be shortened to not extend the full length of the tobacco column 13 or may extend in varying directions. Thus, many alterations to the burn rate of the partial double wrap cigarette 10 of the present invention may be established based upon the combination of factors noted herein, among others.

As depicted in FIG. 1, the partial double wrap cigarette 10 of the present invention which has a modified burn rate characteristic incorporates an outer wrap paper 12 with a first and a second separate partial inner wrap strip 14. The outer wrap cigarette paper 12 may be a normal porosity paper which typically exhibits a porosity of 15-80 Coresta units. In combination with the outer wrap cigarette paper 12 is positioned at least one partial inner wrap layer which can modify the burn rate characteristics of the cigarette 10. As shown, a first and a second partial inner wrap layer 14 are provided on opposite sides of the tobacco column 13. In order to provide substantially equivalent burn rate characteristics along the entirety of the tobacco column 13, the partial inner wrap strips 14 may substantially extend and be co-axial with the tobacco column 13 to the filter 15.

Figure 4:
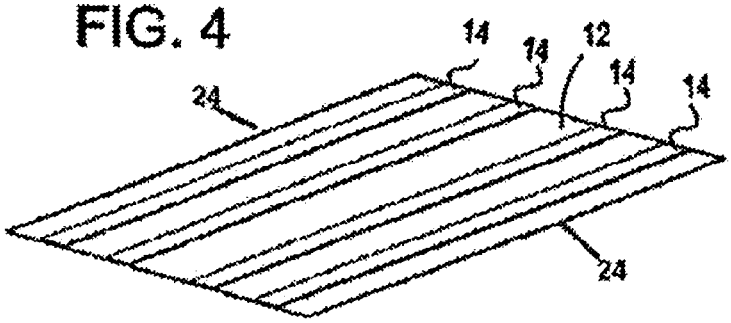
FIG. 4 is a perspective view of the cigarette wrapper of the present invention including strips of the bandcast reconstituted tobacco sheet.

As depicted in the embodiment of FIG. 4, the partial inner wrap layers 14 extend from end to end of the tobacco column 13 and may be positioned such that they are either equal distant from each other or may be placed in alternative positions based upon the desired burn rate characteristics.

Figure 3:
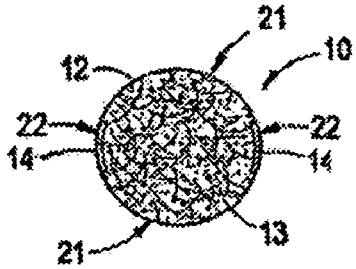
FIG. 3 is an end view of the cigarette of FIG. 1.

Turning to FIG. 3, it is apparent that the partial double wrap cigarette 10 of the present invention has alternating high diffusion areas 21 and low diffusion areas 22 based upon the placement of the inner wrap layers or strips 14. As can be seen, the high diffusion areas 21 of which there is at least one, allow for increased permeation of CO and oxygen gases through the barrier formed by the outer wrap 12 while maintaining normal deliveries. In combination, low diffusion areas 22 which are defined by the circumferential extent of each of the partial inner wrap layers 14 may potentially block a significant portion or all of the inflow and outflow of gases therethrough related directly to the porosity of the inner wrap layer 14 in combination with the outer wrap layer 12. The co-linear zones of high diffusion area 21 and low diffusion area 22 may exhibit a porosity of greater than 14 Coresta for the co-linear high diffusion areas and less than 8 Coresta for the co-linear low diffusion areas.

Figure 2:
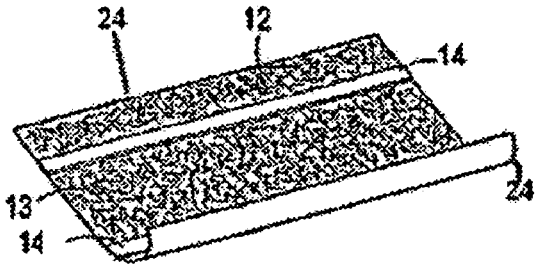
FIG. 2 is a perspective view of an unrolled cigarette wrapper including strips of the bandcast reconstituted tobacco sheet of the present invention.

As shown in the drawings, the construction of the cigarette with burn rate modification is a partial double wrap cigarette 10 depicted herein and utilizes a standard outer wrap cigarette paper 12 which, in a typical cigarette, is 27 mm wide. Placed along the interior of the outer wrap, as shown in FIG. 2 and in FIG. 4 in an alternative embodiment, is located the separate partial inner wrap layer 14 which may substantially extend along the length of the outer wrap 12. While the outer wrap of the cigarette paper may be standard porosity and construction, the partial inner wrap of this embodiment has a first and a second strip 14 each of which may be 4 mm in width and which may have a porosity of less than 8 Coresta units. Therefore, combined, the two inner wrap layers or strips 14 may circumscribe about 8 mm of the circumference of the partial double wrap cigarette 10 of the present invention but may extend around a circumference of up to 15 mm of the tobacco column in relation to a standard cigarette dimension. Any combination of the partial inner wrap and outer wrap may work depending on the variables noted, such as porosity of each paper, but it is felt that good burn rate characteristips as well as limited effects to smoke characteristics and flavor may be achieved by incorporating an inner wrap which covers less than about 75% or preferably less than about 60% and even more preferably less than about 35% of the circumference of the outer wrap. This is a function of the overall cigarette and may vary depending on the circumference of the outer wrap. However, variations are available to achieve the same favorable results utilizing the inventive aspects of the present design and such descriptions are not felt to be limiting and are exemplary only.

Alternatively, many different constructions may be utilized to provide the cigarette with burn rate modification as set forth herein. As may be understood, a single inner wrap layer or a plurality of inner wrap layers may be provided based upon the desired characteristics and burn rate modification. Thus, as previously mentioned, combinations of low porosity inner wrap segments and higher porosity outer wrap segments may be utilized to provide various linear burn rates which may be desirable. Thus, a typical linear burn rate of 6.0 mm per minute may be reduced as desired based upon a combination of porosity of outer wrap and partial inner wrap strips among other factors and may readily be reduced to below 4 mm/minute if needed. This includes formulation of single inner wrap strips of lower porosity or replacement of the inner wrap strips with various construction material including reconstituted tobacco, low porosity paper, bandcast tobacco, a polymer based material, other paper or material. The inner wrap strips may be coated with burn modifiers or other materials which would create at least one low diffusion area along the tobacco column. The paper may be coated with, as an example, sodium alginate as a burn inhibitor in order to decrease the porosity of the paper and provide adequate characteristics such that the entire combination of outer wrap porosity, tobacco packing density, inner wrap circumference covered and number of strips, inner wrap porosity and other factors cause the cigarette to exhibit a desired burn rate.

As depicted in FIG. 4, the opened standard outer wrap 12 is lined with a plurality of inner wrap or inner layer strips 14. These strips may be placed equidistantly apart along the interior of the outer wrap 12 and positioned away from the edges or seam where the outer wrap is adhered to itself during rolling within the garniture of the cigarette maker. As depicted, the strips 14 may all be fed into the garniture and incorporated on the interior of the outer wrap adjacent the tobacco column. Placement of the partial inner wrap strips modifies the burn rate to a desired level such that the rate may be decreased sufficiently to cause either a significantly reduced static burn rate or self-extinguishment at a desired interval.

As may be appreciated, extending the inner wrap layer substantially along the length of the tobacco column 13 such that they are co-axial provides a significant benefit over alternating rings which are perpendicular to the axis of the tobacco column 13. Such perpendicular rings which alternate along the length of the tobacco column may provide a non-linear burn rate of the tobacco column 13. Thus, in such a design where there are circumscribing rings around the tobacco column, the linear burn rate becomes variable between a low linear burn rate to a high linear burn rate depending upon the porosity of the paper at the point of the rings as opposed to the porosity of the non-adjusted paper between the rings. Such non-linear burn rate may in fact be undesirable in that continued free burning of the tobacco column between the rings for significant periods of time does not produce an appropriate burn rate modification which can be depended upon through the entire tobacco column length. Further, at points where the low porosity rings are present, a smoker may puff on the cigarette as the burning of the tobacco column passes over a low porosity ring. At such a point, it is thought that the deliveries of the cigarette may be altered significantly to increase the CO and other compounds provided as the cigarette burns over one of these rings. Thus, the partial double wrap inner layer of the present invention overcomes these problems by providing known standard deliveries over the entire length of the tobacco column while also modifying the burn rate along the entire co-axial length.

In the design of the cigarette with the burn rate modification 10 of the present invention, it may be desirable to incorporate the inner wrap layers, whether a plurality of strips or a single layer, away from the seam of the outer wrap 12. As is known in cigarette manufacturing, the seam 23, depicted in FIG. 1, is formed by the maker by over-wrapping the side edges 24 of the outer wrap 12. In typical cigarette manufacturing, an adhesive is applied along one of the edges 24 prior to folding of the outer wrap and formation of the tobacco column 13. During manufacturing of the cigarette with burn rate modification 10 of the present invention, it is desirable to maintain the partial inner wrap layer away from the seam portion to assure that the outer wrap 12 is properly formed and the partial inner wrap layer does not intercede in the formation of the tobacco column or adhesive of the outer wrap layer. Thus, as depicted in the embodiments, the partial inner wrap layers are shown to be placed away from the side edges 24 so that the inner wrap portions will not interfere with the seam of the outer wrap 12 nor interfere with the formation of the tobacco column within the garniture in a typical cigarette manufacturing machine. Thus, the cigarette with burn rate modification of the present invention may be implemented on standard cigarette making machines with only minor modifications made to the paper feeding devices and no modifications therefore will necessarily be required within the garniture. It is also apparent that in any of the embodiments shown herein the strips may be alternatively placed on the exterior of the cigarette and retained on the wrapper by adhesives or other means so that there are still formed co-linear zones of high and low porosity.

The cigarette with burn rate modification of the present invention may be designed with variations in outer wrap and inner wrap paper characteristics. As previously explained, standard outer wrap designs are such that the typical outer wrap has a linear laid out width of 27 mm and generally a porosity of between 15 and 80 Coresta units. As is generally understood, significantly decreasing the outer wrap porosity changes the deliveries and linear burn rate of the cigarette. Modification of the standard burn rate for a normal or typical cigarette may be obtained through addition of a partial inner wrap to the cigarette. The partial inner wrap may be a single inner wrap portion or may be a plurality of inner wrap strips as shown in the various figures. The partial inner wrap may have paper characteristics with a significantly reduced porosity such that the inner wrap paper exhibits a porosity of less than 8 Coresta units.

EXAMPLES

Several product examples were made using the construction of a partial strip wrap or partial inner wrap cigarette using the inventive techniques and construction described herein. In the examples, a control cigarette was used having no partial inner wrap strips which exhibited a linear burn rate of between 4.3-4.7 mm/min. Different materials where utilized, as detailed in the chart below, for the partial inner wrap strips ranging from standard treated paper to band cast tobacco material.

Examples of cigarettes with two band cast inner wrap strips having a porosity of band cast material less than 5 CORESTA units:

| Cig. | Outer Wrapper Porosity CORESTA | Outer Wrap Citrate % | Inner Strips Number | Inner Strip Width mm | Linear Burn Rate (LBR) mm/min | Self Extinguishment On 10 layers % |
|---|---|---|---|---|---|---|
| 1 | 50 | 0.5 | 0 | 0 | 4.3 | 0 |
| 2 | 50 | 0.5 | 2 | 4 | 3.1 | 100 |
| 3 | 50 | 0.5 | 2 | 5 | 2.6 | 100 |
| 4 | 50 | 0.5 | 2 | 6 | 2.7 | 100 |
| 5 | 40 | 0.7 | 0 | 0 | 4.7 | 0 |
| 6 | 40 | 0.7 | 2 | 3 | 3.8 | 48 |
| 7 | 30 | 0.6 | 0 | 0 | 4.3 | 0 |
| 8 | 30 | 0.6 | 2 | 4 | 3.1 | 100 |

Examples of cigarettes with two cigarette paper strips treated or covered with sodium alginate having a porosity of inner strip paper less than 5 CORESTA units:

| Cig. | Outer Wrapper Porosity CORESTA | Outer Wrap Citrate % | Inner Strips Number | Inner Strip Width mm | Linear Burn Rate (LBR) mm/min | Self Extinguishment On 10 layers % |
|---|---|---|---|---|---|---|
| 9 | 70 | 0.6 | 0 | 0 | 4.4 | 0 |
| 10 | 70 | 0.6 | 2 | 2 | 3.8 | 25 |

Examples of cigarettes detailing smoke deliveries of two samples with band cast strips:

| Cig | Outer Wrapper Porosity CORESTA | Outer Wrap Citrate % | Inner Strip Number | Inner Strip Width mm | Linear Burn Rate (LBR) mm/min | Self Extinguishment On 10 layers % | tar mg/cig | Nicotine mg/cig | CO mg/cig | Puff Number |
|---|---|---|---|---|---|---|---|---|---|---|
| 11 | 70 | 0.6 | 2 | 4 | 3.9 | 90 | 15.5 | 14 | 12.2 | 10.3 |
| 12 | 50 | 0.5 | 2 | 4 | 3.8 | 90 | 14.5 | 0.9 | 14.6 | 7.3 |

In the examples presented, it is apparent that the addition of the partial inner wrap to the cigarette had a definite impact on linear burn rate and self extinguishment as compared to the control cigarette. The linear burn rate for the cigarettes using the present invention was directly affected and evidenced a reduction in linear burn rate by up to 40 percent. Where inner wrap strips were utilized having a width of at least 4 mm, all test samples self extinguished. Narrower width-strips had differing results which could be modified by using alternative additives or increasing the number of strips. References to the self-extinguishment of the cigarette on 10 layers is related to the NIST test for flammability.

Smoking Article Including Strips of Bandcast Reconstituted Tobacco

The separate partial inner wrap strips 14 may be strips of bandcast reconstituted tobacco made in accordance with the specific formula and process for making same as discussed hereinafter. The outer wrap cigarette paper 12 may be a normal porosity paper which typically exhibits a porosity of 15-80 Coresta units. As shown in FIG. 2, two strips 14 of a reconstituted tobacco sheet are provided on opposite sides of the tobacco column 13 to provide a partial inner wrap layer. The partial inner wrap layer including the reconstituted tobacco strips 14 may extend substantially the length of and be co-axial with the tobacco column 13. In one embodiment, the strips are placed equidistant from each other such that the resulting cigarette burns evenly.

Preparation of a Bandcast Reconstituted Tobacco Sheet

In the preparation of a bandcast reconstituted tobacco sheet for use in a cigarette, wood pulp, and a binder, such as sodium alginate, and tobacco particles are slowly added to a tank containing water therein, the materials added while mixing under high shear insuring that each component is thoroughly dissolved or dispersed in the slurry. Particularly, it is desirable to add in order, wood pulp, tobacco and then alginate. Glycerine may also be added for sheet pliability and is generally added after the alginate and before any additional flavorant. Moreover, in a preferred slurry, a desired flavoring may also be added, one particularly desired flavoring being menthol. Inert fillers, such as calcium carbonate and the like, may also be added to the slurry. It has been found that the ratio of tobacco to alginate is preferably about 1.0 To 1.0. The resulting slurry is spread thinly on a casting surface, such as a stainless steel band, that is heated to approximately 200° F. The slurry spread remains on the heated belt until the resulting sheet is dry enough to be removed intact from the belt. The resulting bandcast sheet may be used immediately or conditioned at 100° F. in low humidity for 24 hours or more to further "seal in" any flavoring additives, such as menthol. The sheet may then be shredded and added to a tobacco blend or cut into elongated strips of a desired width and used as longitudinally extending strips along the outer periphery of a tobacco rod and the inner surface of an outer paper wrap. Smoking articles using these inner strips of reconstituted tobacco including menthol therein maintain their menthol flavor in open packs for significant periods of time up to 1 month. In sealed packs, they maintain their menthol flavor for at least 4 months.

In a preferred mix, the tobacco is from 15 to 40% by weight; the wood pulp is from about 5 to 15% by weight; the binder is from 15 to 30% by weight and if a flavoring is added, such a menthol, the flavoring will be up to 30% by weight. Preferably, the tobacco will be approximately 26% by weight, the wood pulp will be approximately 13.5% by weight, the binder will be approximately 27% by weight, and menthol will be approximately 20% by weight. The total mix will be from 2 to 8% by weight in the slurry formulation.

A more comprehensive understanding of the invention can be obtained by considering the following examples. However, it should be understood that the examples are not intended to be unduly limitative of the invention.

EXAMPLES

The following examples demonstrate the procedure that was followed in preparing a bandcast reconstituted tobacco sheet for use in a smoking article.

Example I

In the process of making the bandcast reconstituted tobacco sheet, 130 gallons of water is put into a first vessel having a high shear agitator therein. While the water is being agitated, 35 pounds of wood pulp is added and thoroughly dispersed, 70 pounds of tobacco is added and thoroughly dispersed, 70 pounds of sodium alginate is added and thoroughly dispersed, 35 pounds of glycerine is added and thoroughly dispersed. In a separate tank, 52.5 pounds of menthol is added to 15 gallons of water at 40° C.; the mixture is agitated until the menthol is melted. The resulting mixture is added to the alginate slurry and thoroughly dispersed. More water is added to keep the viscosity between 10,000 to 20,000 centipoise, preferably 15,000 centipoise to ensure proper casting.

The slurry is then cast onto a stainless steel band which is maintained at approximately 200° F. at a thickness of about 40-60 mils. The sheet remains on the stainless steel belt until dry, which is approximately 6-8 minutes. The resulting mentholated bandcast sheet is maintained in sheet form until cut into strips for use in a cigarette article.

Cigarette articles having elongate strips of the bandcast reconstituted sheet disposed between the paper wrapper and the outer surface of the tobacco rod have been found to retain their menthol flavor for 1 month in open packs. In sealed packs, the cigarette articles retain their menthol flavor for at least 4 months and maybe up to a year.

It is to be understood that the invention is not to be limited to the specific examples shown as the parameters set forth in the examples may be varied by appropriate changes of the amounts of the constituents within the reconstituted bandcast tobacco sheet mix used in the examples.

What is claimed is:

1. A cigarette with burn rate modification comprising:

a tobacco column surrounded by an outer wrap paper; and, a partial inner wrap material comprising a plurality of substantially equidistantly spaced partial inner wrap strips extending substantially along said tobacco column and positioned away from a seam of said outer wrap, said partial inner wrap strips being less than about 15 mm in width, said partial inner wrap strips being of a bandcast tobacco sheet which is comprised of from about 5 to 15% by weight of wood pulp, from about 15 to 40% by weight of binder, and from about 15 to 40% by weight of tobacco, said tobacco and said binder being in a ratio of about 1.0 to 1.0.

2. The cigarette of claim 1 including up to about 30% by weight of menthol in said inner wrap.

3. The cigarette of claim 2 wherein said menthol is approximately 20% by weight of said inner wrap.

4. The cigarette of claim 1 including up to about 30% by weight of a humectant in said inner wrap.

5. The cigarette of claim 4, said humectant being glycerine.

6. The cigarette of claim 5, said glycerine being approximately 13.5% by weight.

7. The cigarette of claim 1, said binder being an alginate.

8. The cigarette of claim 7, said alginate being sodium alginate.

9. The cigarette of claim 8, said sodium alginate being about 27% by weight.

10. A bandcast tobacco sheet which is comprised of from about 5 to 15% by weight of wood pulp, from about 15 to 40% by weight of binder, and from about 15 to 40% by weight of tobacco, said tobacco and said binder being in a ratio of about 1.0 to 1.0.

11. The sheet of claim 10 including up to about 30% by weight of menthol.

12. The sheet of claim 11 wherein said menthol is approximately 20% by weight of said sheet.

13. The sheet of claim 10 including up to about 30% by weight of a humectant.

14. The sheet of claim 13, said humectant being glycerine.

15. The sheet of claim 14, said glycerine being approximately 13.5% by weight.

16. The sheet of claim 10, said binder being an alginate.

17. The sheet of claim 16, said alginate being sodium alginate.

18. The sheet of claim 17, said sodium alginate being about 27% by weight.

19. The sheet of claim 10 formed in a plurality of longitudinal strips, said strips inserted into a cigarette adjacent a column of tobacco.

20. The sheet of claim 19 wherein said plurality of longitudinal strips are a first and a second strip equidistant from each other, and positioned away from the seam of the outer warp of said cigarette.

* * * * *